United States Patent [19]

Oike et al.

[11] Patent Number: 4,875,961

[45] Date of Patent: Oct. 24, 1989

[54] HEAT-SENSITIVE TRANSFER MEDIUM

[75] Inventors: Hitoshi Oike; Motoshige Yanagimachi, both of Kyoto, Japan

[73] Assignee: Oike Industrial Co., Ltd., Kyoto, Japan

[21] Appl. No.: 105,283

[22] Filed: Oct. 7, 1987

[30] Foreign Application Priority Data

| | | | |
|---|---|---|---|
| Oct. 7, 1986 | [JP] | Japan | 61-238748 |
| Oct. 14, 1986 | [JP] | Japan | 61-244735 |
| Feb. 16, 1987 | [JP] | Japan | 62-32984 |

[51] Int. Cl.[4] ..... B41M 5/26

[52] U.S. Cl. ..... 156/234; 156/239; 156/240; 156/277; 428/195; 428/209; 428/214; 428/216; 428/336; 428/344; 428/346; 428/354; 428/488.4; 428/913; 428/914; 428/704; 428/411.1

[58] Field of Search ..... 428/195, 204, 207, 209, 428/211, 913, 914, 421, 422, 214, 216, 336, 344, 346, 354, 488.4, 411.1, 704; 156/234, 239, 240, 277

[56] References Cited

U.S. PATENT DOCUMENTS

| | | | |
|---|---|---|---|
| 3,235,395 | 7/1966 | Scharf | 428/195 |
| 4,101,698 | 7/1978 | Dunning et al. | 428/209 |
| 4,250,209 | 2/1981 | de Leeuw et al. | 428/209 |
| 4,495,232 | 1/1985 | Bauser et al. | 428/41 |
| 4,559,273 | 12/1985 | Kutukake et al. | 428/484 |
| 4,581,266 | 4/1986 | Magnotta | 428/40 |
| 4,614,682 | 9/1986 | Suzuki et al. | 428/323 |

FOREIGN PATENT DOCUMENTS

| | | | |
|---|---|---|---|
| 169705 | 1/1986 | European Pat. Off. | 428/488.4 |
| 151096 | 8/1985 | Japan | 428/488.4 |

*Primary Examiner*—Ellis P. Robinson
*Assistant Examiner*—P. R. Schwartz
*Attorney, Agent, or Firm*—Oblon, Spivak, McClelland, Maier & Neustadt

[57] ABSTRACT

A heat-sensitive transfer medium comprising a support, and a transfer layer comprising at least a non-flowable ink layer and an adhesive layer, said two layers being provided in that order from the support side. The transfer medium can give a print image of a high quality on a rough paper.

31 Claims, 1 Drawing Sheet

HEAT-SENSITIVE TRANSFER MEDIUM

BACKGROUND OF THE INVENTION

The present invention relates to a heat-sensitive transfer medium for use in thermal transfer apparatuses such as thermal printer, facsimile and typewriter. More particularly, it relates to a heat-sensitive transfer medium capable of producing a print image of a high quality on a receiving paper which is poor in surface smoothness.

A heat-sensitive transfer medium which has been widely used heretofore is that wherein a heat-meltable ink layer which is melted in a prescribed temperature is provided on a support, for instance, having a thickness of 3 to 12 μm.

The mechanism of printing using such heat-sensitive transfer medium is as follows: A thermal head is brought into contact with the back surface of the support of the transfer medium. When plural heating elements of the thermal head are selectively activated on the basis of signals for printing to generate heat, portions of the heat-meltable ink layer which are positioned on the heated portions of the support are melted and transferred to a receiving medium, such as plain paper, which is brought into contact with the heat-meltable ink layer, providing transfer images of the heat-meltable ink corresponding to the printing signals on the receiving medium. Thus, the use of the heat-sensitive transfer medium makes possible printing onto a plain paper.

In the case of using the conventional heat-sensitive transfer medium, the transferred ink is bonded to a receiving paper by penetration of the ink in a molten state into the surface layer of the paper. Therefore, the bonding of the ink image is readily subject to the surface property of the receiving paper. For example, when a bond paper having a Bekk smoothness of less than 40 seconds is used as a receiving paper, the bonding of the ink to the paper becomes ununiform, which results in reduction of the image quality.

Further, the use of a conventional heat-sensitive transfer medium having a heat-meltable ink layer wherein a heat-meltable binder having a low melt-viscosity is used causes a blot or blur of a print image. In particular, when the thickness of the ink layer is large, there are problems such as marked blot or blur of the print image and decrease in printing speed. Further, when a print image is formed on a plastic film or sheet for overhead projector (hereinafter referred to as "OHP film"), the ink in a molten state tends to spread laterally so that a sharp image cannot be obtained.

A heat-sensitive transfer medium consisting of a support, a heat-meltable ink layer provided on the support and a transfer-assisting layer provided on the ink layer is proposed (Japanese Unexamined Patent Publication No. 114889/1986). However, a coloring agent contained in the ink layer migrates into the transfer-assisting layer, which results in occurrence of a blot or blur of a print image. Further, a thick ink layer is required in order to obtain a print image with a high density. However, such a thick ink layer is poor in transfer selectivity which means that a portion of the ink layer which is heated with an activated heating element and separated from the support faithfully corresponds to the plane shape of the heating element. The poor transfer selectivity reduces the reproductivity of the same image. Moreover, the thick ink layer ruins the heat conduction so that printing speed is decreased.

On the other hand, a plastic film is usually used as a support for the above-mentioned heat-sensitive transfer medium. However, usual plastic films have a melting or softening temperature of 200° to 300° C. at the highest and also a heat deformation temperature of 100° C. at the highest, while the surface temperature of the thermal head goes up to high temperatures of 300° to 400° C. When such plastic film as the support is heated with the thermal head during printing, the so-called "hot-sticking phenomenon" occurs. The hot-sticking phenomenon involves disadvantages such as sticking of the thermal head to the plastic film (hereinafter referred simply to as "sticking"), which causes hindering in the feeding of the transfer medium; and attaching of some melts (hereinafter referred to as "sticking-dust") of the plastic film to the thermal head.

In order to prevent such hot-sticking phenomenon, heretofore, an attempt that a sticking-preventive layer was provided on the back surface of the plastic film which was to be brought into contact with the thermal head was made. As the sticking-preventive layer, there were proposed a metal layer, a heat-resistant resin layer, a layer composed of benztriazole, an ethyl cellulose layer containing sodium stearyl sulfate and a polyester resin layer containing stearic acid. However, these sticking-preventive layers had drawbacks that when the thickness was small, a sufficient sticking-preventive effect was not attained, and when the thickness was large, the heat-sensitivity was reduced due to an increase in heat capacity and the sticking-preventive layer itself rather causes sticking and sticking-dust.

It is an object of the present invention to provide a heat-sensitive transfer medium capable of producing a transfer image of a very good quality on a receiving medium, particularly a paper having a poor surface smoothness such as bond paper, without being subject to the surface property of the receiving medium, with saving the printing energy at a high speed.

Another object of the present invention is to provide a heat-sensitive transfer medium capable of producing a sharp image on an OHP film.

Still another object of the present invention is to provide a heat-sensitive transfer medium improved in sticking-preventive property as well as the above-mentioned ability of producing transfer images of a high quality.

These and other object of the invetnion will become apparent from the description hereinafter.

SUMMARY OF THE INVENTION

The present invention provides a heat-sensitive transfer medium comprising a support, and a transfer layer comprising at least a non-flowable ink layer and an adhesive layer, said two layers being provided in that order from the support side. If desired, a metal deposition layer is interposed between the non-flowable ink layer and the adhesive layer. The transfer medium can give a transfer image of a high quality even on a rough paper such as bond paper or on an OHP film.

The present invention further provides a heat-sensitive transfer medium wherein a sticking-preventive layer comprising, as a main component, a fluorine-containing compound such as a fluorine-containing surface active agent or a fluorine-containing polymer is provided on the back surface of the support of the above-mentioned transfer medium. The transfer medium exhibits an excellent sticking-preventive effect due to improved heat-resistance and slipping property between the transfer medium and the thermal head.

DETAILED DESCRIPTION

A feature of the present invention is that a transfer layer comprising integrated plural layers, i.e. a non-flowable ink layer and an adhesive layer, and, if desired, a metal layer interposed between the non-flowable ink layer and the adhesive layer, is used instead of the heat-meltable ink layer of the conventional heat-sensitive transfer medium.

When the transfer layer is transferred to a receiving medium by means of a thermal head, a transfer image of a good quality can be produced even on a receiving medium having a poor surface smoothness such as bond paper without being subject to the surface property of the receiving medium.

Figure 1:
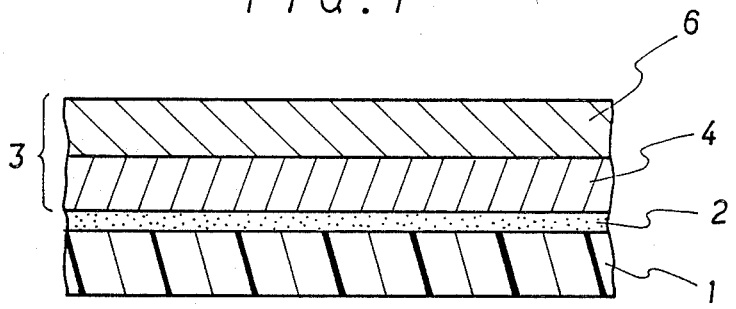
FIG. 1 is a schematic cross-section showing an embodiment of the heat-sensitive transfer medium of the present invention.

Referring to FIG. 1, a heat-sensitive transfer medium in accordance with the present invention comprises a support 1 and a transfer layer 3 comprising a non-flowable ink layer 4 and an adhesive layer 6, which layers 4 and 6 are provided in that order from the support side. The non-flowable ink layer 4 is provided either directly on the support 1 or on a lubricant layer 2 provided on the support 1.

Any known support having a sufficient self-supportabilty can be used as the support 1 without any particular limitation. Examples of the support include films of resins such as polyester, polyamide, polyamidimide, polyethylene, polypropylene, cellulose acetate, polycarbonate, vinyl chloride resin and fluorine-containing resin; cellophane; papers such as glassine paper; and release papers or films.

The preferred support is a film of the foregoing resin and having a thickness of 2 to 9 μm, especially 2 to 6 μm, which ensures mass-production of a heat-sensitive transfer medium having no defects such as wrinkle or crack according to a continuous process. In the case of a conventional hot stamping foil, a support having a thichness of 12 μm is usually used. However, in the case of such a heat-sensitive transfer medium as intended in the present invention, a support having a good heat conduction is required, because a transfer layer must be transferred upon heating for a very short time, for example, 1 to 5 milliseconds, by means of a thermal head. For this reason, a support having a thickness within the above range is preferable.

If a release property between the support 1 and the non-flowable ink layer 4 is poor, it is preferably to provide a lubricant layer 2 on the support 1. Examples of the lubricant used for forming the layer 2 include paraffin waxes, silicone resins, fluorine-containing polymers and surface active agents.

The non-flowable ink layer 4 is intended to mean an ink layer which does not substantially flow at a transfer temperature. The term "transfer temprature" means an average temperature of the ink layer heated during transfer. The transfer temperature for a usual thermal printer is from about 70° to about 140° C.

The non-flowable ink layer 4 may be softened or slightly melted, unless a portion of the in layer heated does not flow as a whole. The non-flowable ink layer 4 is not melted as a whole and has a high internal cohesive force when it is heated for transfer. Therefore, the portions of the ink layer 4 which are heated with the activated heating elements of the thermal head are faithfully transferred to a receiving medium. Thus, a transfer image faithfully corresponding to the activated heating elements can be obtained.

The non-flowable ink layer 4 is composed of a resin and a coloring material.

A variety of resins including thermoplastic resins, thermosetting resins, electron beam-curable resins and ultraviolet radiation-curable resins can be used as a resin for forming the non-flowable layer 4. Typical examples of the resins are acrylic resins, vinyl chloride-vinyl acetate copolymer, polyvinyl butyral, polycarbonate, nitrocellulose, cellulose acetate, styrene-maleic copolymer, urethane resins, urea resins, malamine resins, urea melamine resins, epoxy resins, alkyd resins, amino alkyd resins, chlorinated rubber and rosin-modified maleic resin. These resins may be used singly or as admixtures thereof.

Any dye or pigment which is widely used in the field of printing or recording can be used as the coloring material. Carbon black is usually used for a transfer medium for use in a monochromatic color printer. Coloring materials of various colors including three primary colors, i.e. cyan, magenta and yellow are used for a transfer medium for a chromatic color printer. The content of the coloring material in the non-flowable ink layer 4 is usually from 2 to 80% by weight.

The thickness of the non-flowable ink layer 4 in not particularly limited. Usually, however, a thickness of 0.05 to 10 μm, especially 1 to 2 μm is preferably because of a great covering power and a good transfer selectivity.

The non-flowable ink layer 4 is formed by applying a solution or dispersion of the above-mentioned resin and coloring material in an organic solvent or water onto the support 1 or onto the lubricant layer 2 by a usual coating method such as roller coating, gravure coating, reverse coating or spray coating and drying the resulting coating (hardening or curing in the case of the thermosetting resin, electron beam-curable resin or ultraviolet radiation-curable resin).

The adhesive layer 6 used in the present invention need not contain a coloring material such as carbon black, differing from the conventional heat-meltable ink layer. Therefore, the adhesive can be selected by taking only the softness and the adhesiveness to a recording medium into consideration and, as a result, a sufficiently soft adhesive layer having a good adhesiveness to a receiving medium can be obtained. Even if a paper having a poor surface smoothness is used as a receiving medium, such adhesive layer is faithfully adhered to or penetrated into the uneven parts of the paper. As a result, an image faithfully corresponding to the heated parts can be obtained. Further, even if the adhesive layer 6 itself is spread laterally and blurred, this does not give an adverse effect on the image quality because the adhesive layer 6 is substantially colorless and transparent and the coloring material contained in the non-flowable ink layer 4 does not migrate into the adhesive layer 6 due to the non-flowability of the ink layer.

The adhesive layer 6 is composed of at least one of waxes, resins and elastomers as a main component. Examples of the waxes, resins and elastomers used include natural waxes such as whale wax, bees wax, lanolin, carnauba wax, candelilla wax and montan wax; synthetic waxes such as paraffin wax, microcrystalline wax, oxidized wax, ester wax and low molecular weight polyethylene; higher fatty acids such as lauric acid, myristic acid, palmitic acid, stearic acid and behenic acid; higher alcohols such as stearyl alcohol and behenyl alcohol; esters such as sucrose fatty acid esters and sorbitan fatty acid esters; amides such as stearoyl amide and oleic amide; resins such as polyamide resins, polyester resins, epoxy resins, polyurethane resins, acrylic resins, vinyl chloride resins, cellulosic resins, vinyl acetate resins, petroleum resins, ethylene-vinyl acetate copolymer resins, phenolic resins and styrene resins; elastomers such as natural rubber, styrene-butadiene rubber, isporene rubber, and chloroprene rubber. These substances may be used singly or as admixtures thereof.

One or more additives including tackifier such as rosin, rosin derivatives, terpene resin or hydrogenated petroleum resin; filler; plasticizer; and antioxidant may be added to the above-mentioned main component.

It is preferable that the adhesive layer 6 has a melting point lower than that of the adhesive layer used in a conventional hot stamping foil for use in stamping on paper, because the adhesive layer used in the present invention must be melted quickly upon heating for an extremely short time (e.g. 1 to 5 milliseconds) by means of a thermal head. Usually the melting point of the adhesive layer is from 70° to 100° C.

The thickness of the adhesive layer 6 varies depending upon the surface property of a receiving medium. However, the thickness is usually selected from the range of 1 to 10 μm. Even when a rough paper having a Bekk smoothness of 1 to 50 seconds is used, an adhesive layer having a small thickness of 1 to 5 μm can be favorably used. The transfer medium of the present invention is also applicable to a usual paper having a smooth surface of an OHP film. In that case, an adhesive layer having a very small thickness of 1 to 2 μm is preferably used.

Figure 2:
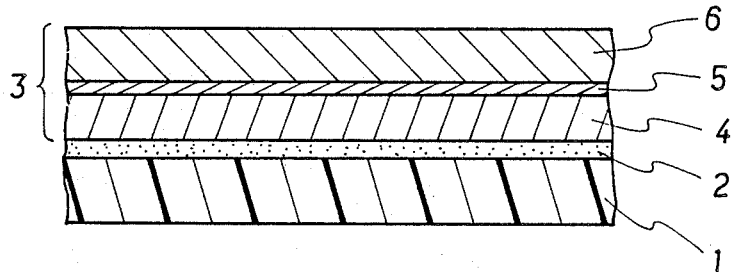
FIG. 2 is a schematic cross-section showing another embodiment of the heat-sensitive transfer medium of the present invetnion.

In the present invention, a metal deposition layer 5 may be interposed between the non-flowable ink layer 4 and the adhesive layer 6, as shown in FIG. 2.

With respect to a print image formed on a recording medium, the metal deposition layer 5 underlies the ink layer 4. Since the metal deposition layer 5 completely shades the light beams reflected from the receiving medium, it functions to increase the density of the print image. Therefore, it is possible to make the non-flowable ink layer 4 relatively thin, which results in improved transfer selectivity and heat-conduction. If a print image having a metallic luster is desired, a transparent ink layer 4 is used.

The metal deposition layer 5 is formed on the non-flowable layer 4 by depositing a metal by a usual thin film forming method such as vacuum-deposition method, sputtering method or ion-plating method. In the present invention, the term "metal" is intended to include metal alloy and metal compound as well as metal. Examples of the materials used for forming the metal deposition layer are metals such as zinc, aluminum, gallium, indium, tin, nickel, silver, gold, copper, silicon, chromiun, titanium, platinum and palladium; mixtures or alloys of two or more foregoing metals; and metal compounds such as intermetallic compound and metal oxide. Aluminum is the most preferably, because of its good shading property and cheapness.

The thickness of the metal deposition layer 5 is preferably from 10 to 100 nm. A metal deposition layer having a thickness of less than 10 nm is undesirable, because it cannot have sufficient shading property or metallic luster. The use of a metal deposition layer having a thickness of more than 100 nm is uneconomical, because it cannot give better shading property or metallic luster than a metal deposition layer having a thickness of 100 nm. The metal deposition layer may be either a single layer or plural layers. In the latter case, different kinds of metals may be used for every layer.

The heat-sensitive transfer medium of the present invention can give a clear image even on a receiving paper having a poor surface smoothness due to the presence of the non-flowable ink layer.

Further, the heat-sensitive transfer medium wherein the metal deposition layer 5 is interposed between the non-flowable ink layer 4 and the adhesive layer 6 can be reduced in the total thickness of its transfer layer 3, which results in an improved heat conduction, whereby the printing speed can be increased and the printing energy can be saved.

The heat-sensitive transfer medium of the present invention can give a clear image on an OHP film. In particular, the heat-sensitive transfer medium containing the metal deposition layer can give a more clear image on the OHP film because of the improved shading property.

Any conventional sticking-preventive layer may be provided on the back surface of the support 1 which is to be brought into contact with a thermal head. In order to prevent sticking, it is also preferably to provide, on the back surface of the support 1, a thin layer of an inorganic substance having a thickness of 6 to 100 nm. Examples of the inorganic substance include oxides such as SiO, $SiO_2$, $TiO_2$, ZnO, $ZrO_2$ and $Al_2O_3$; nitrides such as TiN; carbides such as TiC; carbon; metals such as Al, Ni, Cr, Ti and Ni-Cr alloy, which is disclosed in Japanese Unexamined Patent Publication No. 119097/1987.

Another feature of the present invention is that a sticking-preventive layer containing, as a main component, a fluorine-containing compound such as fluorine-containing surface active agent or fluorine-containing polymer is used.

Figure 3:
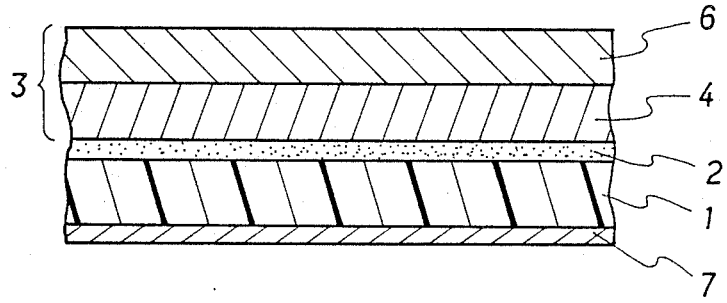
FIG. 3 is a schematic cross-section showing still another embodiment of the heat-sensitive transfer medium of the present invention.

Referring to FIG. 3, a sticking-preventive layer 7 is provided on the back surface of the support 1, preferably resin film, which is to be brought into contact with a thermal head.

The stick-preventive layer 7 is a layer which contains a fluorine-containing compound as a main component and preferably the compound is mixed with a heat-resistant resin.

Preferred examples of the fluorine-containing compound are fluorine-containing surface active agents and fluorine-containing polymers.

Examples of the fluorine-containing surface active agent are anionic fluorine-containing surface active agents including perfluoroalkylsulfonic acid salts such as compound having the formula: $R_f\text{-}SO_3M$, phosphoric esters containing perfluoroalkyl group such as compound having the formula:

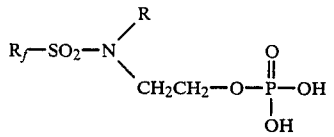

and perfluoroalkyl-containing carboxylic acid salts such as compound having the formula:

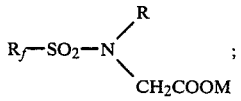

nonionic fluorine-containing surface active agents including perfluoroalkyl-containing polyhydric alcohols such as compound having the formula:

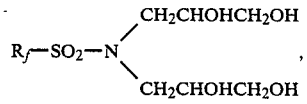

ethylene oxide addition product of perfluoroalcohol, oligomer containing perfluoroalkyl group and hydrophilic group, oligomer containing perfluoroalkyl group and lipophilic group, and urethane prepolymer containing perfluoroalkyl group and lipophilic group; cationic fluorine-containing surface active agents such as perfluoroalkyltrimethylammonium salt; amphoteric fluorine-containing surface active agents such as perfluoroalkylaminosulfonic acid salt. In the above formulae, $R_f$ is a perfluoroalkyl group preferably having 5 to 8 carbon atoms, R is an alkyl group preferably having 1 to 4 carbon atoms, and M is a metal ion. These surface active agents may be used singly or as admixtures thereof. Among these fluorine-containing surface active agents, those having relatively good heat-resistance and application property, such as perfluoroalkylsulfonic acid salt and perfluoroalkyl-containing polyhydric alcohol, are preferably. In particular, perfluoroalkylsulfonic acid salt wherein $R_f$ has 5 to 8 carbon atoms is preferably, because of its excellent heat-resistance.

Examples of the fluorine-containing polymer are tetrafluoroethylene-hexafluoropropylene coploymer, polychlorotrifluoroethylene, polyvinylidene fluoride and polytetrafluoroethylene.

Examples of the heat-resistant resin are thermoplastic or thrmosetting resins having relatively high heat resistance, such as polyether sulfone, polyphenylene sulfide, polysulfone, epoxy resin, silicone resin, polyimide, phenolic resin, melamine resin and nitrocellulose. These resins may be used singly or as admixtures thereof.

The effects exhibited by the fluorine-containing compound, particularly the fluorine-containing surface active agent are as follows: The coating layer containing the fluorine-containing compound makes up the deficiency in heat resistance of the support and prevents the support from sticking to a thermal head heated up to a high temperature. The coating prevents the support from charging, so that a disadvantage that the thermal head, the transfer medium and the receiving paper are attracted to each other due to static electricity is eliminated. Further, the coating reduces the surface friction factor of the support, so that the slipping property between the support and the thermal head is improved.

The proportion of the fluorine-containing compound to the heat-resistant resin varies depending upon their kinds and is not particularly limited.

Usually the content of the fluorine-containing compound in the sticking-preventive layer is from 50 to 65% by weight. When the content is lower than 50% by weight, a sufficient slipping property is not obtained between the support and the thermal head, so that the sticking-preventive effect is not sufficiently improved. When the content is more than 65% by weight, the film-forming property of a coating composition becomes poor, and the resulting sticking-preventive layer rather causes sticking.

the heat-resistant resin used together with the fluorine-containing compound is used for improving application property as well as heat resistance of the fluorine-containing compound.

The content of the heat-resistant resin in the sticking-preventive layer is usually from 35 to 50% by weight. When the content is lower than 35% by weight, the film property and heat resistance of the sticking-preventive layer is not sufficiently improved, though the slipping property is improved. When the content is higher than 50% by weight, the slipping property is reduced, though the film property and heat-resistance are improved.

The sticking-preventive layer 7 is formed by applying a solution of the above components in an organic solvent or water to the back surface of the support by a usual coating method such as roller coating, gravure coating, reverse coating or spray coating and drying or curing the resulting coating.

The thickness of the sticking-preventive coating is preferably from 0.05 to 3 μm, more preferably from 0.1 to 1 μm. When the thickness is less than 0.05 μm, it is difficult to form a uniform coating. A coating having a thickness more than 3 μm is uneconomical, because it does not exhibit a better sticking-preventive effect than the coating having a thickness of 3 μm.

The present invention is more specifically described and explained by means of the following Examples. It is to be understood that the present invention is not limited to the Examples, and various change and modifications may be made in the invention without departing from the spirit and scope thereof.

EXAMPLE 1

A solution prepared by dissolving 9 parts (parts by weight, hereinafter the same) of paraffin wax and 1 part of a ketone resin in a mixed solvent of 70 parts of toluene, 10 parts of terebine oil and 10 parts of petroleum naphtha was applied onto a polyester film having a thickness of 3.5 μm and dried to give a lubricant layer having a thickness of 0.05 μm. A dispersion prepared by dissolving or dispersing 25 parts of styrene-maleic anhydride copolymer resin and 20 parts of carbon black in a mixed solvent of 45 parts of methyl isobutyl ketone and 10 parts of cyclohexanone was applied onto the lubricant layer and dried to give a black non-flowable ink layer having a thickness of 1.5 μm. The ink layer did not flow up to 180° C. A mixture of 80 parts of paraffin wax, 10 parts of ethylene-vinyl acetate copolymer resin and 10 parts of terebine oil was applied onto the ink layer and dried to give an adhesive layer having a thickness of 1 μm and a melting point of 90° C., thereby yielding a heat-sensitive transfer medium for producing a black print image.

EXAMPLE 2

A solution prepared by dissolving 20 parts of a methacrylic ester polymer resin, 10 parts of a chlorinated rubber and 20 parts of a red pigment available under commercial name "Sanyo Tinting Red #747", made by SANYO COLOR WORKS, LTD. into a mixed solvent of 30 parts of toluene, 10 parts of methyl isobutyl ketone and 10 parts of cyclohexanone was applied onto a polyester film having a thickness of 6 μm and dried to give a red non-flowable ink layer having a thickness of 2 μm. The ink layer did not flow up to 200° C. A solution prepared by dissolving 10 parts of a polyamide resin and 10 parts of carnauba wax into a mixed solvent of 70 parts of toluene and 10 parts of isopropyl alcohol was applied onto the ink layer and dried to give an adhesive layer having a thickness of 1.5 μm and a melting point of 90° C., thereby yielding a heat-sensitive transfer medium for producing a red print image.

EXAMPLE 3

A solution prepared by dissolving 9 parts of paraffin wax and 1 part of ketone resin in a mixed solvent of 70 parts of toluene, 10 parts of terebine oil and 10 parts of petroleum naphtha was applied onto a polyester film having a thickness of 3.5 μm and dried to give a lubricant layer having a thickness of 0.5 μm. A dispersion prepared by dissolving or dispersing 25 parts of styrene-maleic anhydride copolymer resin and 20 parts of carbon black in a mixed solvent of 45 parts of methyl isobutyl ketone and 10 parts of cyclohexanone was applied onto the lubricant layer and dried to give a black non-flowable ink layer having a thickness of 1 μm. The ink layer did not flow up to 180° C. Chromium was deposited onto the in, layer by a vacuum-deposition method to give a chromium deposition layer having a thickness of 60 nm. A mixture of 80 parts of paraffin wax, 10 parts of ethylene-vinyl acetate copolymer resin and 10 parts of terebine oil was applied onto the chromium deposition layer and dried to give an adhesive layer having a thickness of 1.5 μm and a melting point of 90° C., thereby yielding a heat-sensitive transfer medium for producing a black print image.

EXAMPLE 4

A solution prepated by dissolving 20 parts of the methacrylic ester resin, 10 parts of a chlorinated rubber and 20 parts of the red pigment (Sanyo Tinting Red #747) into a mixed solvent of 30 parts of toluene, 10 parts of methyl isobutyl ketone and 10 parts of cyclohexanone was applied onto a polyester film having a thickness of 6 μm and dried to give a red non-flowable ink layer having a thickness of 1 μm. The ink layer did not flow up to 200° C. Aluminum was deposited on the ink layer by a vacuum-deposition method to give an aluminum deposition layer having a thickness of 40 nm. A solution prepared by dissolving 10 parts of a polyamide resin and 10 parts of carnauba wax into a mixed solvent of 70 parts of toluene and 10 parts of isopropyl alcohol was applied onto the aluminum deposition layer and dried to give an adhesive layer having a thickness of 1.5 μm and a melting point of 90° C., thereby yielding a heat-sensitive transfer medium for producing a red print image.

Employing each of the heat-sensitive transfer media obtained in Examples 1 to 4, printing was carried out on a bond paper having a Bekk-smoothness of 30 seconds at a speed of 1,800 letters per minute by means of a thermal transfer printer available under commercial name "Canon CW-4253" made by Canon Inc.

The black letter images formed by using the transfer media of Examples 1 and 3 and the red letter images formed by using the transfer media of Examples 2 and 4 were all clear and of a high quality.

EXAMPLE 5

A solution prepared by dissolving 42 parts of perfluoroalkylsufonate wherein the perfluoroalkyl group had 8 carbon atoms ($C_8F_{17}$-$SO_3K$), available under commercial name "MEGAFAC F-110" made by DAI-NIPPON INK AND CHEMICALS, INC. and 40 parts of polysulfone in a mixed solvent of 760 parts of cyclohexanone, 118 parts of methyl ethyl ketone and 40 parts of methyl isobutyl ketone was applied onto one surface of a polyester film having a thickness of 3.5 μm and dried to give a sticking-preventive layer having a thickness of 0.5 μm.

A transfer layer was formed on the opposite surface of the polyester film in the same manner as in Example 1 to give a heat-sensitive transfer medium.

EXAMPLE 6

The same procedures as in Example 2 except that the same sticking-preventive layer as in Example 5 was formed on one surface of the polyester film were repeated to give a heat-sensitive transfer medium.

EXAMPLE 7

The same procedures as in Example 3 except that the same sticking-preventive layer as in Example 5 was formed on one surface of the polyester film were repeated to give a heat-sensitive transfer medium.

EXAMPLE 8

A solution prepared by dissolving 60 parts of perfluoroalkylsufonate (MEGAFAC F-110), 50 parts of silicone resin and 5 parts of a curing agent in 200 parts of xylene was applied onto one surface of a polyester film having a thickness of 6 μm and dried to give a sticking-preventive layer having a thickness of 0.5 μm.

A transfer layer was formed on the opposite surface of the polyester film in the same manner as in Example 4 to give a heat-sensitive transfer medium.

Employing each of the heat-sensitive transfer media obtained in Examples 5 to 8, printing was continuously carried out on 110 sheets of a bond paper having a Bekk smoothness of 30 seconds (A4 size) at a speed of 1,800 letters per minute by means of a thermal transfer printer (Canon CW-4253).

All the letter images formed on every sheet of the bond paper were clear with no defects such as getting out of shape and voids and of the same high density. During printing, there were observed no undesirable phenomena such as sticking of the thermal head to the support film and attaching of melts of the support film to the thermal head, i.e. formation of sticking-dust.

In addition to the ingredients used in the Examples, other ingredients can b eused in the Examples as set forth in the specification to obtain substantially the same results.

What we claim is:

1. A heat-sensitive transfer medium for use in a printing method in which a heat transfer layer, provided on one surface of a support, is brought into contact with a receiving medium and localized areas of in ink layer are heated by means of a thermal head which is brought into contact with the other surface of the support, thereby transferring the heating areas of the transfer layer onto a receiving medium thereby forming printed images thereon, said transfer medium comprising a support and a transfer layer comprising at least a non-flowable, opaque ink layer, a metal deposition layer and an adhesive layer, said three layers being provided in that order from the support side of the medium, said transfer layer being capable of being transferred onto a receiving medium so that the localized areas of said layer that are heated by means of a thermal head are selectively transferred to form non-metallic printed images on the receiving medium said ink layer comprising a resin and a coloring agent and being substantially non-flowable under the transfer conditions, said metal deposition layer acting as a shading layer in the printed images.

2. The transfer medium of claim 1, wherein the thickness of the non-flowable ink layer and the thickness of the adhesive layer are from 1 to 2 μm and from 1 to 5 μm, respectively.

3. The transfer medium of claim 2, wherein the support is a resin film having a thickness of 2 to 9 μm.

4. the transfer medium of claim 1, wherein the adhesive layer is melted at a temperature of 70° to 100° C.

5. The transfer medium of claim 1, wherein the non-flowable ink layer is directly provided on the support.

6. The transfer medium of claim 1, wherein a lubricant layer is interposed between the support and the non-flowable ink layer.

7. The transfer medium of claim 1, wherein a sticking-preventive layer is provided on the back surface of the support which is to be brought into contact with a thermal head.

8. The transfer medium of claim 7, wherein the sticking-preventive layer comprises a fluorine-containing compound as a main component and a heat-resistant resin.

9. The transfer medium of claim 8, wherein the fluorine-containing compound is a fluorine-containing surface active agent.

10. The transfer medium of claim 9, wherein the fluorine-containing surface active agent is perfluoroalkylsulfonic acid salt.

11. The transfer medium of claim 10, wherein the perfluoroalkylsulfonic acid salt is one wherein the perfluoroaklyl group has 5 to 8 carbon atoms.

12. The transfer medium of claim 7, wherein the thickness of the sticking-preventive layer is from 0.05 to 3 μm.

13. The transfer medium of claim 1, wherein said non-flowable ink layer has a thickness ranging from 0.05 to 2 μm.

14. The transfer medium of claim 1, wherein said metal deposition layer has a thickness ranging from 10 to 100 nm.

15. The transfer medium of claim 1, wherein said adhesive layer has a thickness of 1 to 5 μm and has a melting temperature ranging from 70° to 100° C.

16. A method for producing printed images via a heat-sensitive transfer medium which comprises the steps of:

(a) preparing a transfer medium of a support and a transfer layer, said transfer layer comprising at least one non-flowable, opaque ink layer, a metal deposition layer and an adhesive layer, said three layers being provided in that order from the support side of the support;

(b) bringing said transfer layer of the medium into contact with a receiving medium; and (c) heating localized areas of the transfer layer by means of a thermal which is brought into contact with the support of the transfer medium, thereby selectively transferring the heated areas of the transfer layer onto the receiving medium to form non-metallic printed images on the receiving medium, said ink layer comprising a resin and a coloring agent and being substantially non-flowable under the transfer conditions, said metal deposition layer acting as a shading layer in the printed images.

17. The method of claim 16, wherein the thickness of the non-flowable ink layer and the thickness of the adhesive layer are from 1 to 2 μm and from 1 to 5 μm, respectively.

18. The method of claim 17, wherein the support is a resin film having a thickness of 2 to 9 μm.

19. The method of claim 16, wherein the adhesive layer is melted at a temperature of 70° to 100° C.

20. The method of claim 16, wherein the non-flowable ink layer is directly provided on the support.

21. The method of claim 16, wherein a lubricant layer is interposed between the support and the non-flowable ink layer.

22. The method of claim 16, wherein a metal deposition layer is interposed between the non-flowable ink layer and the adhesive layer.

23. The method of claim 16, wherein a sticking-preventive layer is provided on the back surface of the support which is to be brought into contact with a thermal head.

24. The method of claim 23, wherein the sticking-preventive layer comprises a fluorine-containing compound as a main component and a heat-resistant resin.

25. The method of claim 24, wherein the fluorine-containing compound is a fluorine-containing surface active agent.

26. The method of claim 25, wherein the fluorine-containing surface active agent is perfluoroalkylsulfonic acid salt.

27. The method of claim 26, wherein the perfluoroalkylsulfonic acid salt is one wherein the perfluoroalkyl group has 5 to 8 carbon atoms.

28. The method of claim 23, wherein the thickness of the sticking-preventive layer is from 0.05 to 3 μm.

29. The method of claim 16, wherein the receiving medium is a rough paper.

30. The method of claim 29, wherein the rough paper has a Bekk smoothness of not more than 50 seconds.

31. The method of claim 29, wherein the receiving medium is a plastic film or sheet.

* * * * *